US005315814A

United States Patent [19]

Yao

[11] Patent Number: 5,315,814

[45] Date of Patent: May 31, 1994

[54] COMPOUND YARN PRODUCTION APPARATUS

[75] Inventor: Shin-Chuan Yao, Taipei, Taiwan

[73] Assignee: China Textile T&R Institute, Taipei, Taiwan

[21] Appl. No.: 966,437

[22] Filed: Oct. 26, 1992

[51] Int. Cl.[5] ..... D01H 1/02; D01H 13/04

[52] U.S. Cl. ..... 57/75; 57/315; 57/352

[58] Field of Search ..... 57/256, 244, 224, 5, 57/12, 75, 315, 90, 352

[56] References Cited

U.S. PATENT DOCUMENTS

| | | | |
|---|---|---|---|
| 3,043,083 | 7/1962 | Noguera | 57/315 |
| 3,657,871 | 4/1972 | Uchiyama et al. | 57/90 |
| 3,739,566 | 6/1973 | Smith | 57/315 |

FOREIGN PATENT DOCUMENTS

| | | | |
|---|---|---|---|
| 4039305 | 6/1992 | Fed. Rep. of Germany | 57/90 |
| 819935 | 9/1959 | United Kingdom | 57/90 |

*Primary Examiner*—Joseph J. Hail, III

*Attorney, Agent, or Firm*—Morton J. Rosenberg; David I. Klein

[57] ABSTRACT

A production apparatus for spinning ring spinning filaments and staple compound slivers into compound yarns wherein the main improvement comprises altering the three-line roller draft system to a four-line roller draft system, combining multi-filaments with short staple fiber clusters and then the resultant being twisted to form compound ring yarns that are superior to the conventional ring yarns. It indeed achieves the maximum practical value and is adaptable to industry uses.

1 Claim, 2 Drawing Sheets

COMPOUND YARN PRODUCTION APPARATUS

BACKGROUND OF THE INVENTION

As a result of the continuous pursuance of process simplification, cost reduction, and production automation by the industry, a variety of manufacturing methods, such as rotor spinning, air jet spinning, and friction spinning, for conventional ring yarns has been developed. However, the yarns made by these methods differ from that by the ring spinning either in the constitution or in characteristics. Moreover, the complicated processes of the ring spinning and the restriction of the ring and traveler system have made the production rate hard to breakthrough, resulting in a bottle neck. Therefore, many scholars and experts have been trying to simplify manufacturing processes since 1884, but they failed. Some of the major factors are inefficient pre-spinning dust and soil removal, immature roller bearing technology, synthesized rubber technology remaining in its infancy, air conditioning system not being popularized, and so on.

OBJECT OF THE INVENTION

And thus, the principal the invention is to develop the ring spinning technology and make it practicable. Further, multi-filaments, through a series of processes of being separated, combining with short staple fiber clusters, and twisting, finally become compound ring yarns that are superior to conventional ring yarns. As a consequence, the invention provides a variety of choices in fabric design and promotes additional value.

The invention, as well as its many advantages, may be further understood from the following detailed description when read in conjunction with the accompanying drawings.

DETAILED DESCRIPTION

Figure 1:
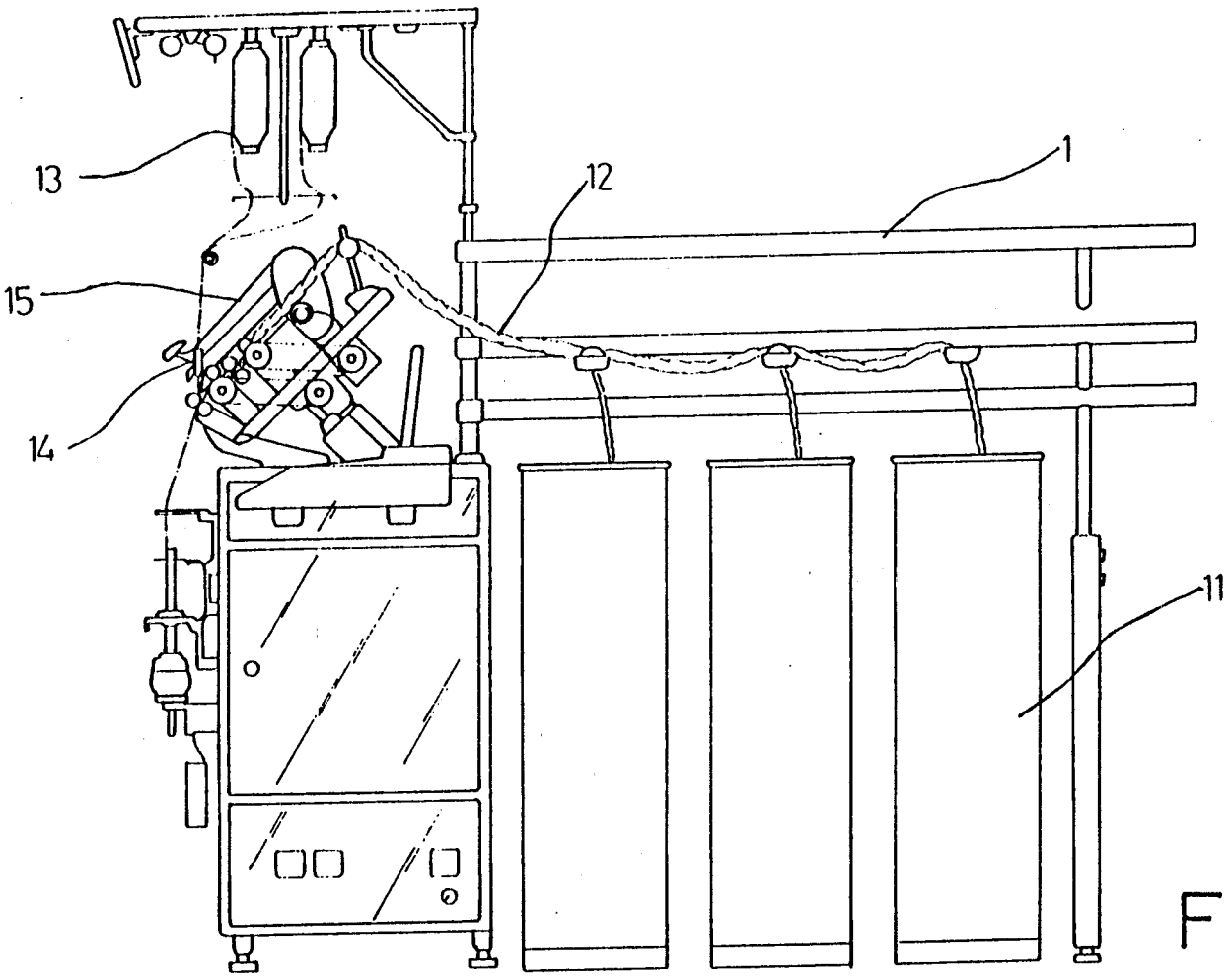
FIG. 1 is a schematic view showing the construction of the invention.

Now referring to FIG. 1, the invention mainly employs a conventional ring spinning machine (1) with some modifications in which the three-line roller draft system has been altered to a four-line roller draft system and a proper sliver collector in association with accurate drafting conditions is adopted. The construction comprises some draw sliver cans (11) provided by the sides of the ring spinning machine (1), and a pressing arm (15) of the four-line draft system on which arm there are mounted direct current electrode heads (14) for filament separating. Following the principle of electric sliver compounding, draw slivers (12) are directly fed without roving processing. Before fiber clusters reach the front roller (2), multi-filament (13) and fibers are uniformly compounded and twisted to yarns.

Figure 2:
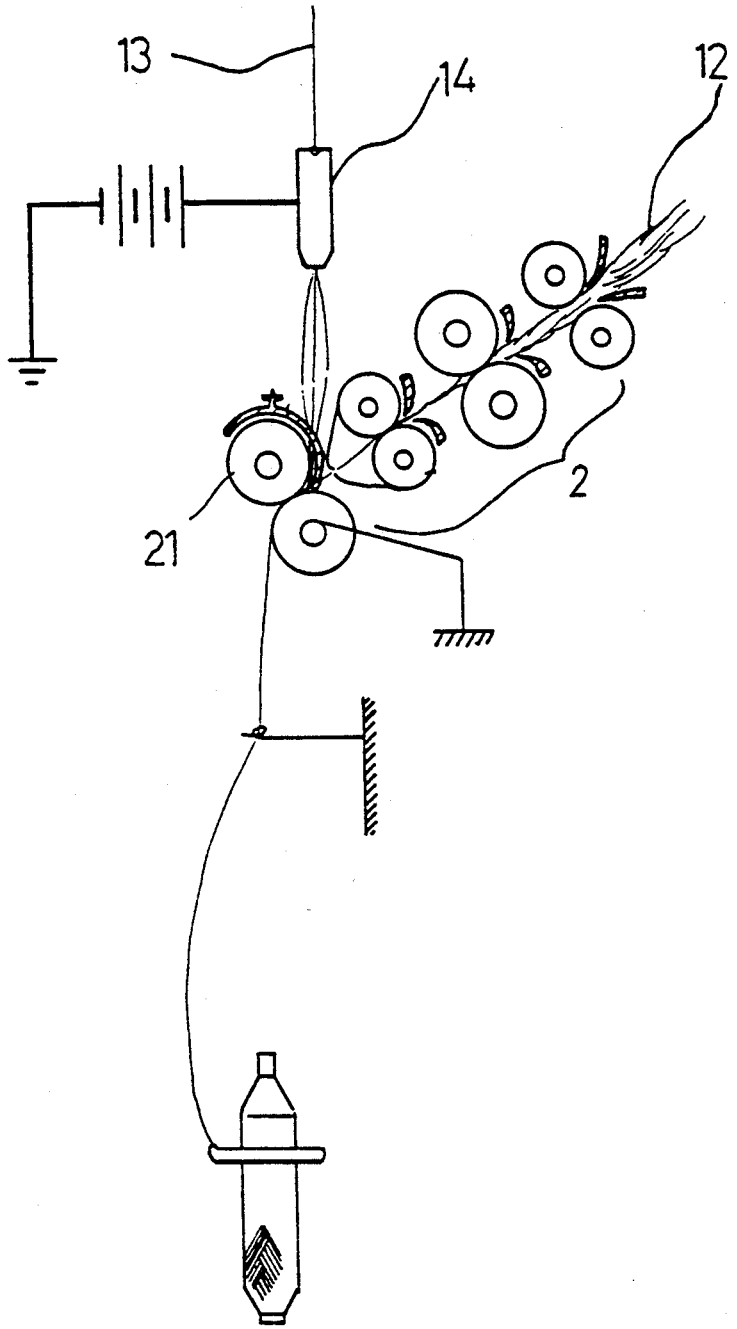
FIG. 2 is a partial view illustrating the mechanism of the invention.

Next, referring to FIG. 2, a schematic view illustrating the production of electric compound filaments, draw slivers are automatically fed by a feeding system without the roving processes of the prior art. That is, by means of the four sets of rollers (2) of the invention, the drafted fiber clusters and multi-filaments being separated by the electrode (14) are smoothly compounded at the front roller (21) and then the resultants are twisted to yarns. In this way, the production of compounding slivers and multi-filaments has been finished and the compound yarns with fine quality are obtained. Comparing the products of the apparatus with conventional ring yarns, we get the following data wherein the material, roller pressure, and gauges are listed here.

1. Material:
   (1) Combed sliver 253gr/6 yd
   (2) Polyester foy 50D/24
   (3) Polyester foy 75D/36
2. Roller pressures: 15/15/20/20 daN (70/*/75/75 Hs)
3. Gauges: 44/42/36 mm

| Quality Number | | CVm % | 1000 m Thin | Thick | Nep | St. | El. | Hari. | Counts |
|---|---|---|---|---|---|---|---|---|---|
| Ne20 T/C (30/70) | compound yarns | 9.87 | 0 | 5 | 10 | 510 | 6.28 | 4.52 | 19.9 |
| | average ring yarns | 11.3 | 0 | 23 | 38 | 431 | 6.09 | 6.65 | 19.5 |
| Ne30 T/C (40/60) | compound yarns | 10.21 | 0 | 10 | 53 | 350 | 6.15 | 3.89 | 28.5 |
| | average ring yarns | 12.82 | 0 | 40 | 75 | 220 | 4.90 | 4.55 | 29.1 |
| Ne45 T/C (40/60) | compound yarns | 12.67 | 3 | 48 | 100 | 210 | 8.79 | 3.40 | 44.3 |
| | average ring yarns | 14.82 | 12 | 136 | 175 | 162 | 4.25 | 4.30 | 45.1 |

As described above, the invention is really a production apparatus that has practical value for the industry and its effects not only promote the quality of products but also satisfy the need of wider design choice.

What is claimed is:

1. A compound yard producing apparatus for spinning multifilament yarn and slivers into compound yarn including a ring spinning machine having a plurality of sliver cans, comprising:

(a) a first set of rollers for drawing said slivers therebetween from said plurality of sliver cans;

(b) a D.C. electrode having said multifilament yarn passing therethrough for separating said multifilament yarn into individual multifilament yarn strands; and, (c) a second set of rollers for combining said individual multifilament yarn strands and said drawn slivers exiting said first set of rollers and forming said combined multifilament yarn strands and drawn slivers into said compound yarn for winding on a bobbin, one of said second set of rollers being grounded whereby said compound yarn is formed without said slivers having a roving process applied thereto.

* * * * *